US006966585B2

(12) United States Patent
Egi et al.

(10) Patent No.: US 6,966,585 B2
(45) Date of Patent: Nov. 22, 2005

(54) DOOR LOCK DEVICE

(75) Inventors: Yasushi Egi, Noda (JP); Seiichi Tomiyama, Mitaka (JP)

(73) Assignee: Jamco Corporation, Tokyo (JP)

( * ) Notice: Subject to any disclaimer, the term of this patent is extended or adjusted under 35 U.S.C. 154(b) by 37 days.

(21) Appl. No.: 10/749,804

(22) Filed: Dec. 31, 2003

(65) Prior Publication Data

US 2005/0140151 A1 Jun. 30, 2005

(51) Int. Cl.[7] ..... E05B 15/02
(52) U.S. Cl. ..... 292/341; 292/144; 292/201; 292/341.15; 292/341.16; 292/341.17
(58) Field of Search ..... 292/341, 341.15, 292/341.16, 144, 201, 341.17

(56) References Cited

U.S. PATENT DOCUMENTS 420,834 A * 2/1890 Seib ..... 292/341.16
3,386,761 A * 6/1968 Johnstone et al. ..... 292/201
3,638,984 A * 2/1972 Davidson ..... 292/341.16
3,774,422 A * 11/1973 Hogan et al. ..... 70/264
3,861,727 A * 1/1975 Froerup et al. ..... 292/341.16
4,756,566 A * 7/1988 Logas ..... 292/341.16
4,948,184 A * 8/1990 Weyerstall et al. ..... 292/216
5,076,625 A * 12/1991 Oxley
5,195,792 A * 3/1993 Stendal ..... 292/341.16
5,257,840 A * 11/1993 Rouzaud ..... 292/201
5,484,180 A * 1/1996 Helmar ..... 292/341.16
5,494,322 A * 2/1996 Menke ..... 292/216
5,681,070 A * 10/1997 Williams et al. ..... 292/341.16
5,735,559 A * 4/1998 Frolov ..... 292/341.16
5,924,750 A * 7/1999 Fuss et al. ..... 292/201
5,988,711 A * 11/1999 Toma ..... 292/341.16
6,349,983 B1 * 2/2002 Dupont et al. ..... 292/201

* cited by examiner

*Primary Examiner*—Brian E. Glessner
*Assistant Examiner*—Carlos Lugo
(74) *Attorney, Agent, or Firm*—Carrier, Blackman & Associates, P.C.; Joseph P. Carrier; William D. Blackman

(57) ABSTRACT

A door lock device includes a latch projecting from the side surface of the door, and a hook supported opposite to the latch in a doorjamb such that the hook can turn between a latch detaining position and a latch releasing position. A hook control member turns between a hook detaining position at a locking position and a hook releasing position. First, second and third rocking plates are interlocked with the hook control member. When a solenoid actuator rod engaging with the third rocking plate projects upward to fasten the door lock device, the third rocking plate is turned clockwise by a pin, and the second rocking plate having a pin pressed against the third rocking plate turns clockwise. Conversely, when the rod is retracted the door lock device is unfastened.

12 Claims, 12 Drawing Sheets

DOOR LOCK DEVICE

BACKGROUND OF THE INVENTION

1. Technical Field

The present invention relates to a door lock device that fastens when an electric power source is connected thereto and unfastens when the electric power source is disconnected therefrom.

2. Related Art

A door lock device that unfastens when an electric power source is disconnected therefrom is needed to enable persons to escape from a building or to enable emergency crew to rush into a building in an emergency.

FIGS. 15A and 15B show horizontal sectional views of a door lock device that fastens when an electric power source is connected thereto in a fastened state, and that unfastens when the electric power source is disconnected therefrom in an unfastened state, respectively, shown in combination with a swing door.

Shown in FIGS. 15A and 15B are swing door 01 hinged for turning about a vertical axis to one doorjamb, on one side of an opening (entrance) of a building, of a doorframe, and the other doorjamb 03 on the other side of the opening installed close to a side surface 01*a* of a swing end of the swing door 01. The swing door 01 swings clockwise from a closed position shown in FIG. 15A toward an open position shown in FIG. 15B. A vertical doorstop 03*a* protruding from the doorjamb 03 limits the turning of the swing door 01 in the closing direction, i.e., upward as viewed in FIG. 15A.

The swing door 01 is provided with a latch 02 that projects from and retracts behind the side surface 01*a*. The latch 02 is pressed in a projecting direction by a spring, not shown. The latch 02 has an outer side surface, i.e., a lower side surface as viewed in FIG. 15A, substantially coinciding with a plane including a pivotal axis about which the swing door 01 swings, and an inner side surface, i.e., an upper side surface as viewed in FIG. 15A inclined to the aforesaid plane.

A cavity 04 for receiving a door lock device is formed in a part of the doorjamb 03 opposite the latch 02.

A hook 06 is supported for turning in the cavity 04 by a shaft 06*a* on the doorjamb 03. The hook 06 has a V-shaped groove 06*b*. A spring, not shown, presses the hook 06 clockwise to locate the hook 06 at a first position shown in FIG. 15A. When the hook 06 is located at the first position, the hook 06 is able to catch the latch 02 projecting from the side surface 01*a* of the swing door 01. When the hook 06 is located at a second position as shown in FIG. 15B, the hook 06 releases the latch 02, so that the swing door 01 is able to swing for opening and closing the entrance.

A hook control member 07 has a shaft 07*a* having a middle part 07*c* of a semicircular cross section, and a lever 07*b* extending perpendicularly to the axis of the shaft 07*a* from a part of the shaft 07*a*. The hook control member 07 is supported on the doorjamb 03 for turning about a vertical axis in the cavity 04 with the flat surface of the middle part 07*c* in contact with the back surface of the hook 06. The hook control member 07 is pressed counterclockwise by a spring, not shown.

The hook control member 07 is capable of restraining the hook 06 from turning. The flat surface of the middle part 07*c* is in contact with the back surface of the hook 06 to detain the hook 06 at its first position when located at its first position as shown in FIG. 15A. The hook control member 07 releases the hook 06 when located at its second position as shown in FIG. 15B so that the hook 06 can be turned from its first position to its second position by the resilience of the spring.

FIGS. 16A and 16B show a hook control member locking mechanism disposed below the hook 06 and the hook control member 07. The hook control member locking mechanism includes a solenoid actuator provided with a movable core. The movable core of the solenoid actuator is engaged with the hook control member 07 to detain the hook control member 07 at its first position as shown in FIG. 16A and disengaged from the hook control member 07 to release the hook control member 07 as shown in FIG. 16B.

The shaft 07*a* of the hook control member 07 is supported by a bearing member 010*a* formed on a base 010. A pair of U-shaped first rocking plates 015 are connected by a connecting pin 015*a* so as to be spaced a predetermined distance apart from each other. The bar parts of the first rocking plates 015 are supported for turning by a shaft 016 on a pair of bearing plates 013 fixed to the base 010. A roller 017 is placed between and supported for rotation on the free ends of the upper legs of the first rocking plates 015. The first rocking plates 015 are pressed clockwise by a spring, not shown, toward their first position shown in FIG. 16A. When the first rocking plates 015 are located at their first position as shown in FIG. 16A, the roller 017 is engaged with the lever 07*b* of the hook control member 07 to detain the hook control member 07 at its first position. Thus, the first rocking plates 017 restrain the hook 06 from turning through the hook control member 07. When the first rocking plates 015 are located at their second position as shown in FIG. 16B, the hook control member 07 is released and permitted to turn to its second position.

A second rocking plate 021 is supported for turning on the bearing plate 013. The second rocking plate 021 is provided with a groove 021*a*. A roller 021*b* is attached to an upper end part of the second rocking plate 021. When the second rocking plate 021 is turned from its first position shown in FIG. 16A to its second position shown in FIG. 16B, the roller 021*b* attached to the second rocking plate 021 pushes up the lower legs of the first rocking plates 015 to turn the first rocking plates 015 to their second position as shown in FIG. 16B. A stopper 023 limits the clockwise turning of the second rocking plate 021.

A solenoid actuator 030 provided with a plunger is attached to the base 010. A rod 036 is fixed to the movable core, not shown, of the solenoid actuator 030. A pin 038 attached to the rod 036 is engaged in the groove 021*a* of the second rocking plate 021. The movable core, not shown, and the rod 036 attached to the movable core are pulled down when a solenoid included in the solenoid actuator 030 is energized, and are pushed up by the resilience of a spring, not shown, when the solenoid is de-energized.

The rod 036 attached to the movable core, not shown, of the solenoid actuator 030 is pulled down by magnetic force. Consequently, the second rocking plate 021 having the groove 021*a* in which the pin 038 attached to the rod 036 is engaged is located at the first position as shown in FIG. 16A and, hence the first rocking plates 015 are held at their first position as shown in FIG. 16A by a spring, not shown. In this state, the roller 017 supported on the first rocking plates 015 is engaged with the lever 07*b* of the hook control member 07 to detain the hook control member 07 at its first position. Consequently, the door lock device is in a locking state to detain the hook 06 at its first position as shown in FIG. 15A, and hence the swing door 01 cannot be opened.

When the solenoid of the solenoid actuator 030 is de-energized, the magnetic force that acts to pull down the rod 036 disappears, the rod 036 is pushed up by the spring, not shown, and the pin 038 of the second rocking plate 021 engaged in the groove 021*a* turns the second rocking plate 021 to the second position as shown in FIG. 16B. Thus, the roller 012*b* supported on the second rocking plate 021 pushes up the lower legs of the first rocking plates 015 to raise the roller 017 engaged with the lever 07*b* of the hook control member 07 so that the roller 017 is disengaged from the lever 07*b* of the hook control member 07. Consequently, the hook 06 detained at the first position is released, and the hook 06 pressed by the spring is able to turn between its first position and its second position.

When an opening force is applied to the swing door 01 in this state, the hook 06 is turned counterclockwise and the hook control member is turned clockwise as shown in FIG. 15B against the resilience of the springs. Thus, the door lock device unfastens and the swing door 01 is opened.

After the door 01 has been opened, the hook 06 and the hook control member 07 are returned to their first positions as shown in FIG. 15A by the resilience of the springs. When a closing force is applied manually or with a door check or the like to the swing door 01, the hook 06 and the hook control member 07 do not turn, the latch 02 projecting from the side surface 01*a* of the swing door 01 retracts against the resilience of the spring and rides over the edge of the hook 06 into the groove 06*b* as shown in FIG. 15A to keep the swing door 01 closed.

When a high lateral pressure P is applied to the hook 06 in a door opening direction with this known door lock device fastened, the pressure P presses the lever 07*b* of the hook control member 07 against the roller 017 supported on the first rocking plates 015 to exert a very high frictional force on the roller 017. Consequently, it is possible that the resilience of the spring of the solenoid actuator 030 is unable to disengage the roller 017 from the lever 07*b* of the hook control member 07, the door lock device is unable to unfasten, and hence the swing door 01 cannot be opened.

It is an object of the present invention to provide a door lock device capable of surely unfastening to enable a swing door to open even if a high lateral pressure acts in a door opening direction.

With this object in view, the present invention provides a door lock device comprising: a latch placed in a side part of a swing door hinged for swinging in an opening of a building to open and close the opening, the latch being elastically pressed so as to project from the side part of the swing door, and capable of being manually pushed into the swing door; a hook disposed so as to engage with the latch in a cavity formed in a part of a door frame defining the opening of the building and corresponding to the latch, the hook being capable of turning between a latch detaining position for detaining the latch and a latch releasing position for releasing the latch; a hook control member provided to move between a hook detaining position for restraining the hook from turning from the latch detaining position and a hook releasing position for permitting the hook to turn to the latch releasing position; an actuator having a rod capable of being advanced for a locking operation and retracted for an unlocking operation; a first member capable of turning between a first position for detaining the hook control member at the hook detaining position and a second position for permitting the hook control member to turn to the hook releasing position, and pressed in a direction from the second position toward the first position; a second member having one end that engages with the first member to detain the first member at the first position, the second member being provided to turn between a first position where the one end thereof detains the first member at the first position and a second position where the one end thereof is separated from the first member to permit the first member to turn to its second position, the second member being pressed in a direction from its second position toward its first position, and provided with an engaging member; and a third member supported for turning adjacent to the second member so as to be turned by the actuator, capable of being turned to a first position by advancing the rod of the actuator and to a second position by retracting the rod of the actuator, the third member being pressed in a direction from its second position toward its first position, and capable of restraining the second member from turning toward its first position by engaging with the engaging member of the second member; wherein the first member has a impact-receiving part that receives impact exerted thereon by the second member when the rod of the actuator is retracted and the second member turns from its first to its second position, whereby the first member can be surely turned toward its second position by the impact exerted on the impact-receiving part thereof. The door lock device may include a pair of the first members connected in spaced relation to each other.

In the door lock device according to the present invention, the impact is applied to the impact-receiving parts of the first members to turn the first members so that the hook is released as the third member turns in an unlocking direction when the rod of the actuator is retracted. Therefore, the rod of the actuator can be retracted to unfasten the door lock device even if high lateral pressure is working on the swing door in a state where the door lock device is fastened because the second member turns rapidly and exerts the impact on the impact-receiving parts when the rod of the actuator is retracted to make the first members release the hook, and the hook is able to turn.

According to the present invention, the second member may be disposed so that the end part of the second member exerts the impact on the impact-receiving parts. The impact-receiving parts may be projections formed in the first members.

Preferably, the second and the third member are supported on a common shaft. The engaging member of the second member may be a pin. The third member may be provided with a projection that engages with the engaging member. The second and the third member may be restrained from turning beyond their first positions by stoppers, respectively. The third member may be provided with a recess, the rod of the actuator may be provided with a pin so as to engage in the recess of the third member.

DETAILED DESCRIPTION OF THE PREFERRED EMBODIMENT

Figure 1A:
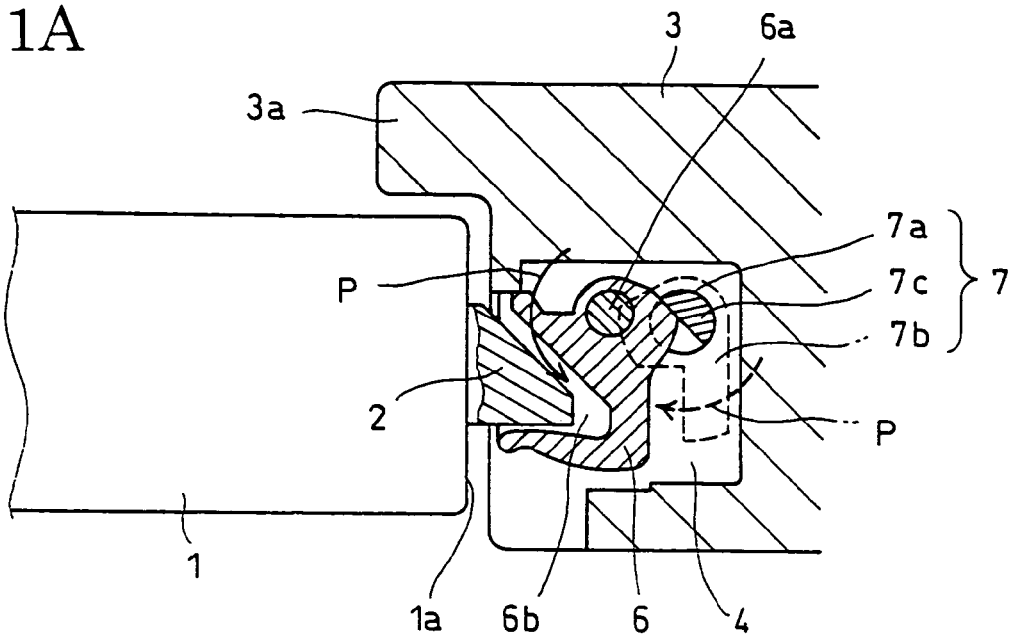
FIGS. 1A and 1B are horizontal sectional views of a door lock device in a preferred embodiment according to the present invention in a fastened state and in an unfastened state, respectively, shown in combination with an associated swing door.
Figure 1B:
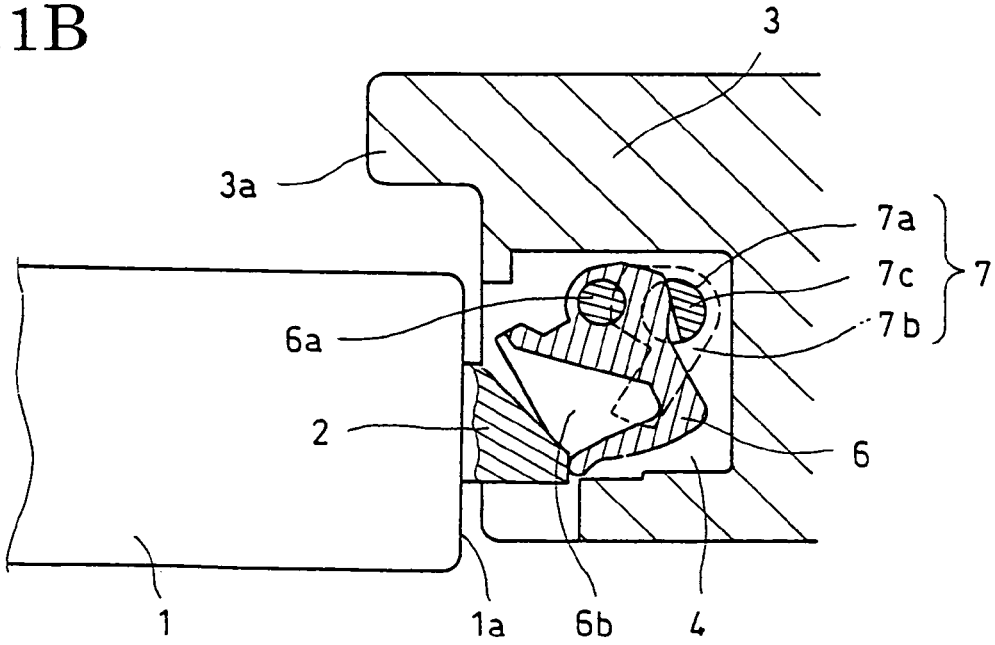

FIGS. 1A and 1B are horizontal sectional views of a door lock device in a preferred embodiment of the present invention in a fastened state and in an unfastened state, respectively, shown in combination with an associated swing door.

Shown in FIGS. 1A and 1B are swing door 1 hinged for turning about a vertical axis to one doorjamb, on one side of an opening (entrance) of a building, of a doorframe, and the other doorjamb 3 on the other side of the opening installed close to a side surface 1*a* of a swing end of the swing door 1. The swing door 1 swings clockwise from a closed position shown in FIG. 1A toward an open position shown in FIG. 1B. A vertical doorstop 3*a* protruding from the doorjamb 3 limits the turning of the swing door 1 in the closing direction, i.e., upward as viewed in FIGS. 1A and 1B.

The swing door 1 is provided with a latch 2 that projects from and retracts behind the side surface 1*a*. The latch 2 is pressed in a projecting direction by a spring, not shown. The latch 2 has an outer side surface, i.e., a lower side surface as viewed in FIGS. 1A and 1B, substantially coinciding with a plane including a pivotal axis about which the swing door 1 swings, and an inner side surface, i.e., an upper side surface as viewed in FIGS. 1A and 1B, inclined to the aforesaid plane.

A cavity 4 for containing a door lock device is formed in a part of the doorjamb 3 opposite the latch 2.

A hook 6 is supported for turning in the cavity 4 by a shaft 6*a* on the doorjamb 3. The hook 6 has a V-shaped groove 6*b*. A spring, not shown, presses the hook 6 clockwise to locate the hook 6 at a latch detaining position as shown in FIG. 1A. When the hook 6 is located at the latch detaining position, the hook 6 is able to catch the latch 2 projecting from the side surface 1*a* of the swing door 1. When the hook 6 is located at a latch releasing position as shown in FIG. 1B, the hook 6 releases the latch 2, so that the swing door 1 is able to swing for opening and closing the entrance.

A hook control member 7 has a shaft 7*a* having a middle part 7*c* having a semicircular cross section, and a lever 7*b* extending perpendicularly to the axis of the shaft 7*a* from a part of the shaft 7*a*. The hook control member 7 is supported on the doorjamb 3 for turning about a vertical axis in the cavity 4 with the flat surface of the middle part 7*c* in contact with the back surface of the hook 6. The hook control member 7 is pressed counterclockwise by a spring, not shown.

The hook control member 7 is capable of restraining the hook 6 from turning. The flat surface of the middle part 7*c* of the middle part 7*c* is in contact with the back surface of the hook 6 to detain the hook 6 at a latch detaining position when located at a hook detaining position as shown in FIG. 1A. The hook control member 7 releases the hook 6 when located at a hook releasing position as shown in FIG. 1B so that the hook 6 can be turned from the latch detaining position to a latch releasing position by the resilience of the spring.

Figure 2:
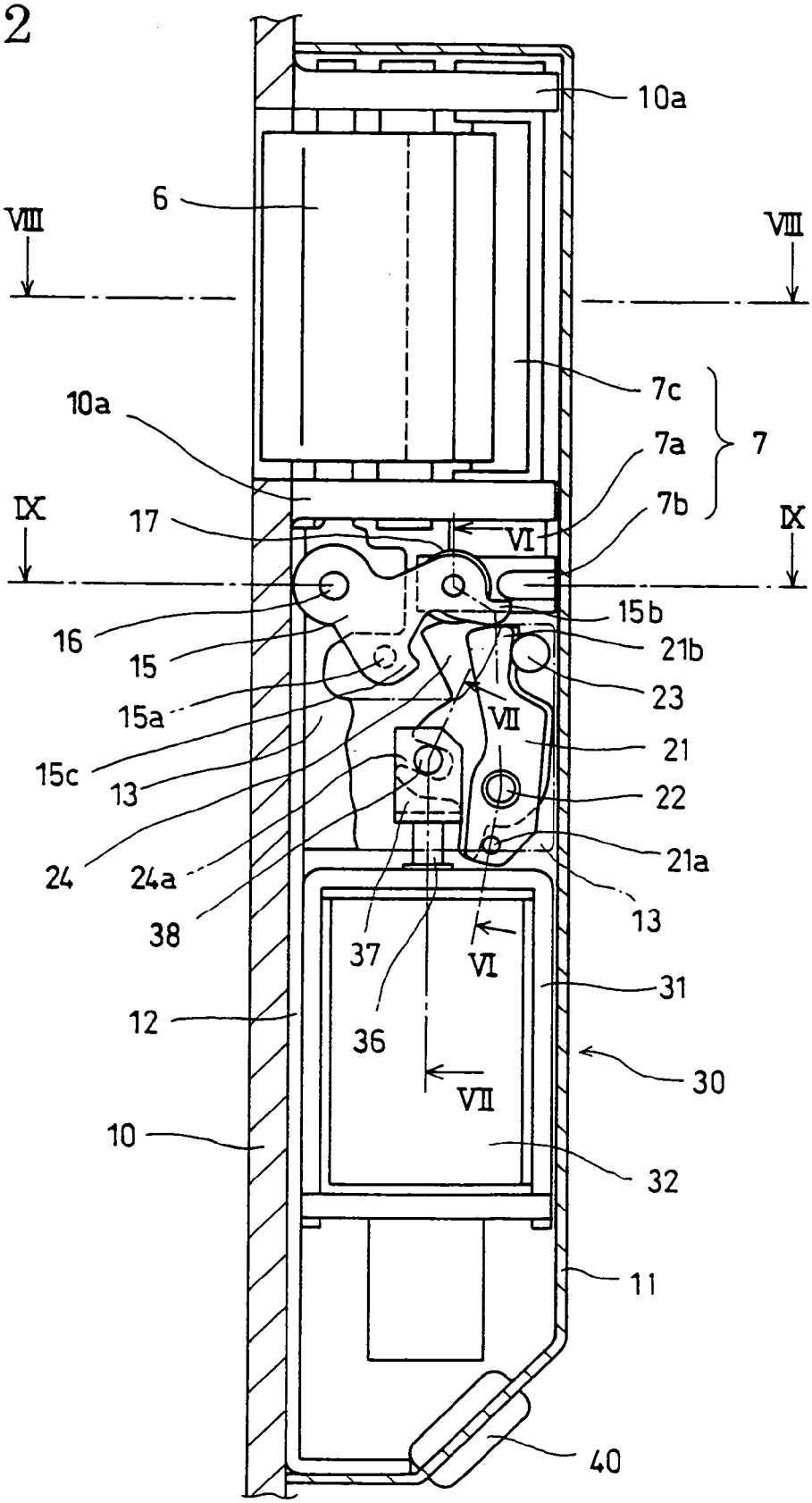
FIG. 2 is a front elevation of the door lock device shown in FIGS. 1A and 1B in a fastened state.
Figure 3:
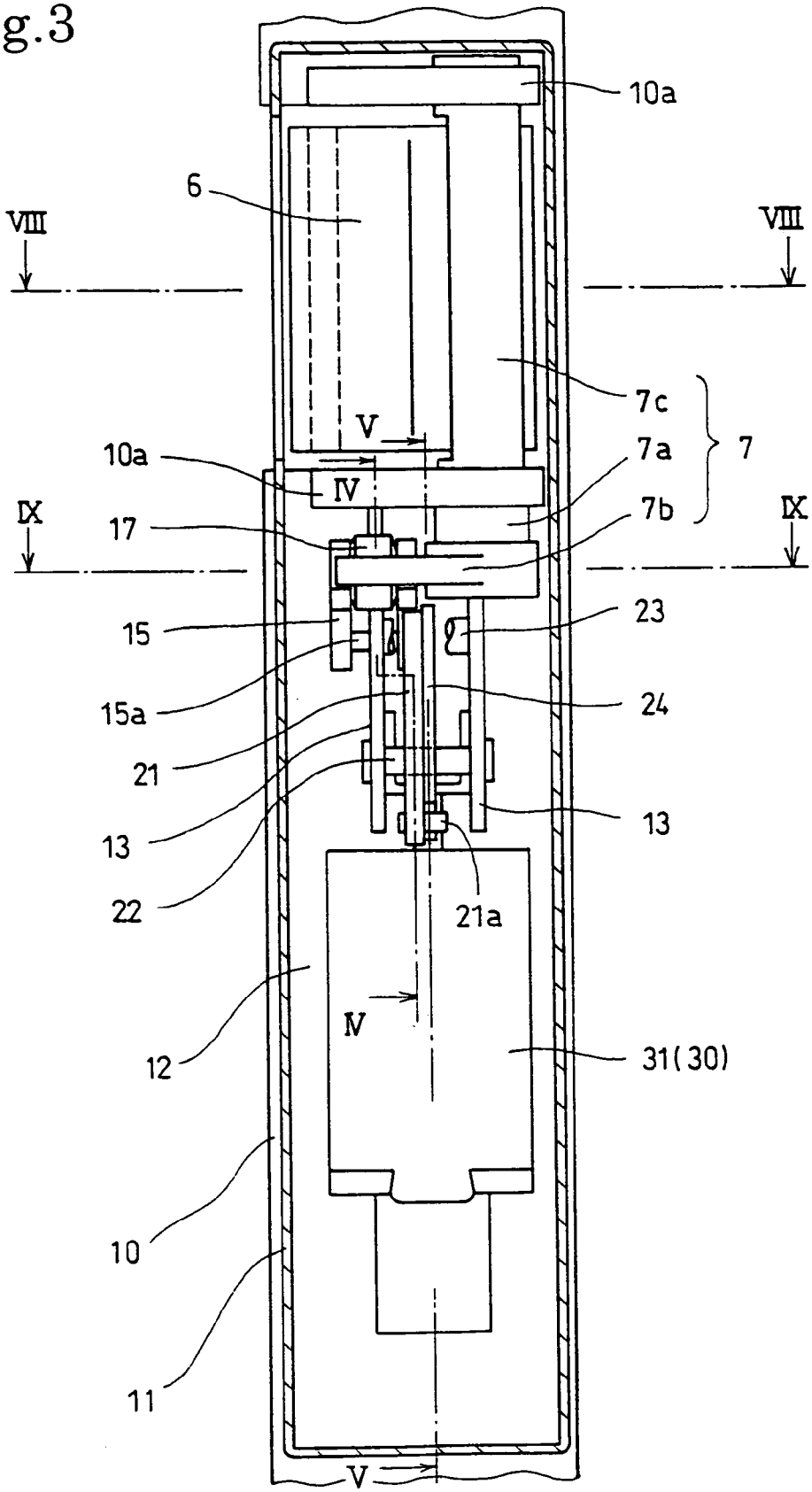
FIG. 3 is a side elevation of the door lock device shown in FIGS. 1A and 1B taken from the left side in FIG. 2.

Referring to FIGS. 2 and 3, the door lock device is mounted on a base 10 and is covered with a cover 11. The door lock device is contained entirely in the cavity 4 formed in the doorjamb 3. A wall on the left side as viewed in FIG. 2 of the base 10 has a surface facing the side surface 1*a* of the swing door 1.

The hook 6 and the hook control member 7 are supported on upper and lower bearing parts 10*a* of the base 10. A mounting plate 12 is attached to the base 10 so as to extend under the lower bearing part 10*a*. A hook control member operating mechanism is mounted on the mounting plate 12. A linear solenoid actuator 30 drives the hook control member operating mechanism to detain the hook control member 7 at the latch detaining position or at the latch releasing position.

Figure 4:
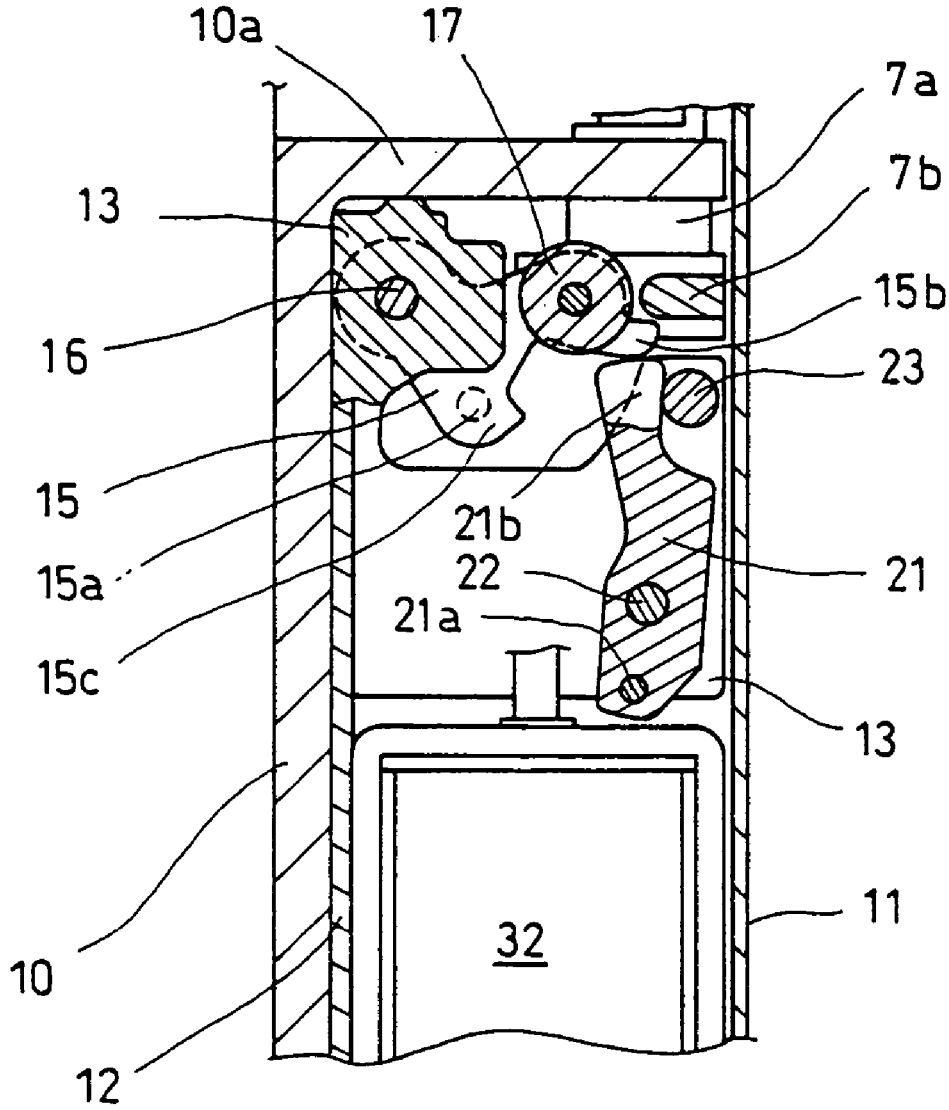
FIG. 4 is a sectional view taken on the line IV—IV in FIG. 3.
Figure 6:
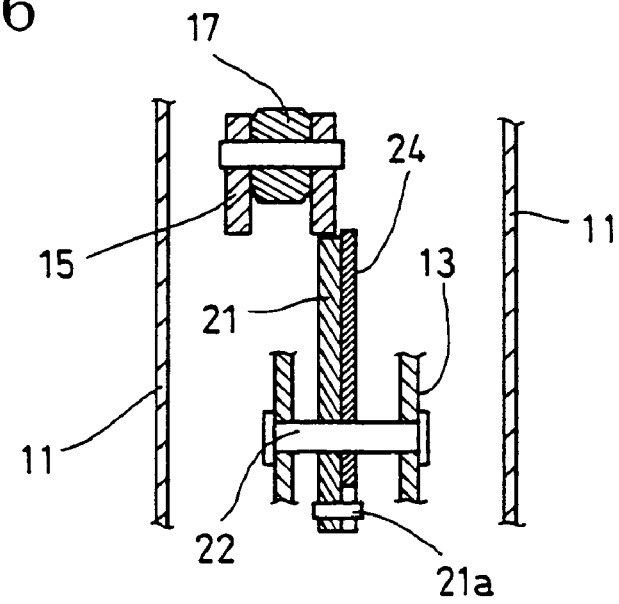
FIG. 6 is a sectional view taken on the line VI—VI in FIG. 2.
Figure 7:
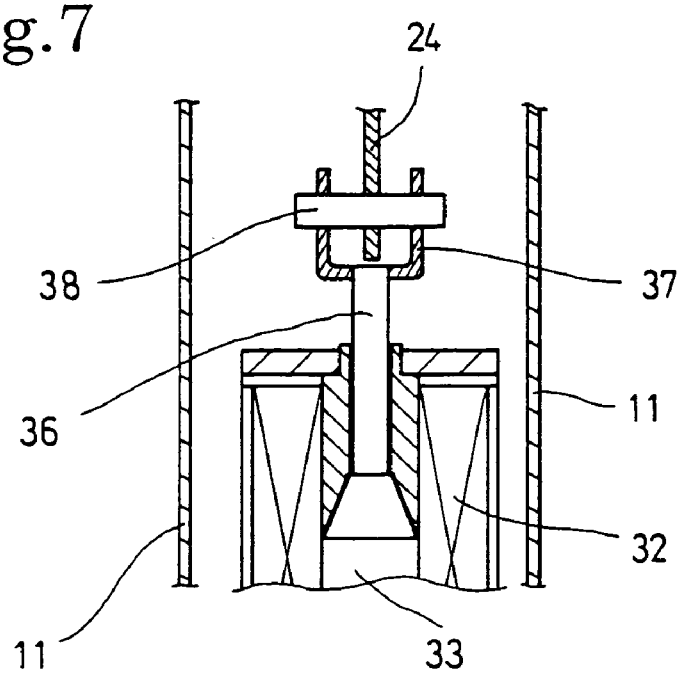
FIG. 7 is a sectional view taken on the line VII—VII in FIG. 2.
Figure 8:
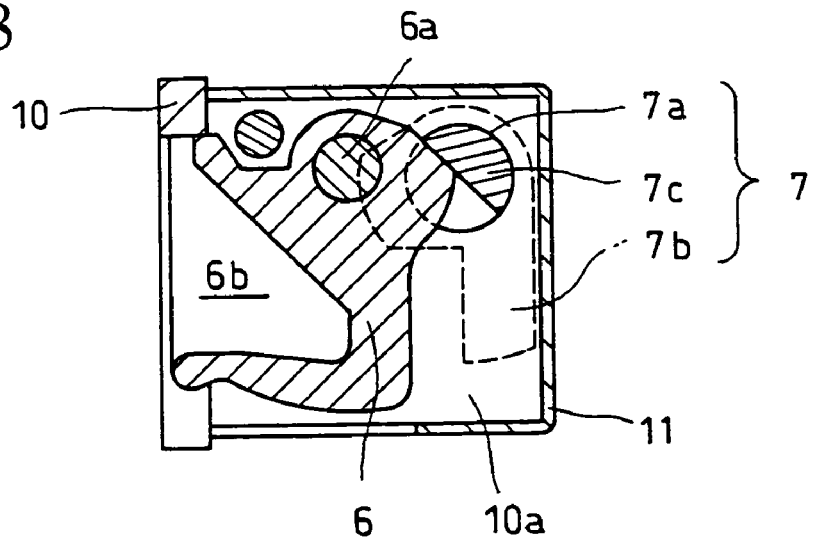
FIG. 8 is a sectional view taken on the line VIII—VIII in FIG. 2 or 3.

Referring to FIGS. 4, 6 and 8, a pair of first rocking plates 15, i.e., a pair of first members, are connected by a connecting pin 15*a* so as to be spaced a predetermined distance apart from each other. The first rocking plates 15 are supported for swing motion on a horizontal shaft 16 supported on a pair of bearing plates 13 fixed to the mounting plate 12. A roller 17 is placed between and supported for rotation on free ends of the first rocking plates 15 apart from the shaft 16. The first rocking plates 15 are pressed counterclockwise as viewed in FIGS. 2 and 4 by a spring, not shown, toward their first position shown in FIG. 4. When th first rocking plates 15 are located at their first position as shown in FIG. 4, projections 15*b* projecting from the free end of the first rocking plates 15 remotest from the shaft 16 rest on the lever 7*b* of the hook control member 7 to limit the counterclockwise turning of the first rocking plates 15. when the first rocking plates 15 are located at the first position, the roller 17 is in contact with the lever 7*b* to detain the hook control member 7 at the hook detaining position. The first rocking plates 15 are provided with second projections 15*c*, i.e., impact-receiving parts, in their lower parts.

A second rocking plate 21, i.e., a second member, is supported for turning by a shaft 22 on the bearing plate 13. A spring, not shown, presses the second rocking plate 21 clockwise as viewed in FIGS. 2 and 4 toward a first position. In FIGS. 2 and 4, the second rocking plate 21 is located at the first position. An upper part 21*b* of the second rocking plate 21 rests on a stopper 23 extended between the pair of bearing plates 13. The stopper 23 restrains the clockwise turning of the second rocking plate 21 beyond the first position. When the second rocking plate 21 is located at the first position, the upper part 21*b* is in contact with the projections 15*b* of the first rocking plates 15 to hold the first rocking plates at the first position.

Figure 5:
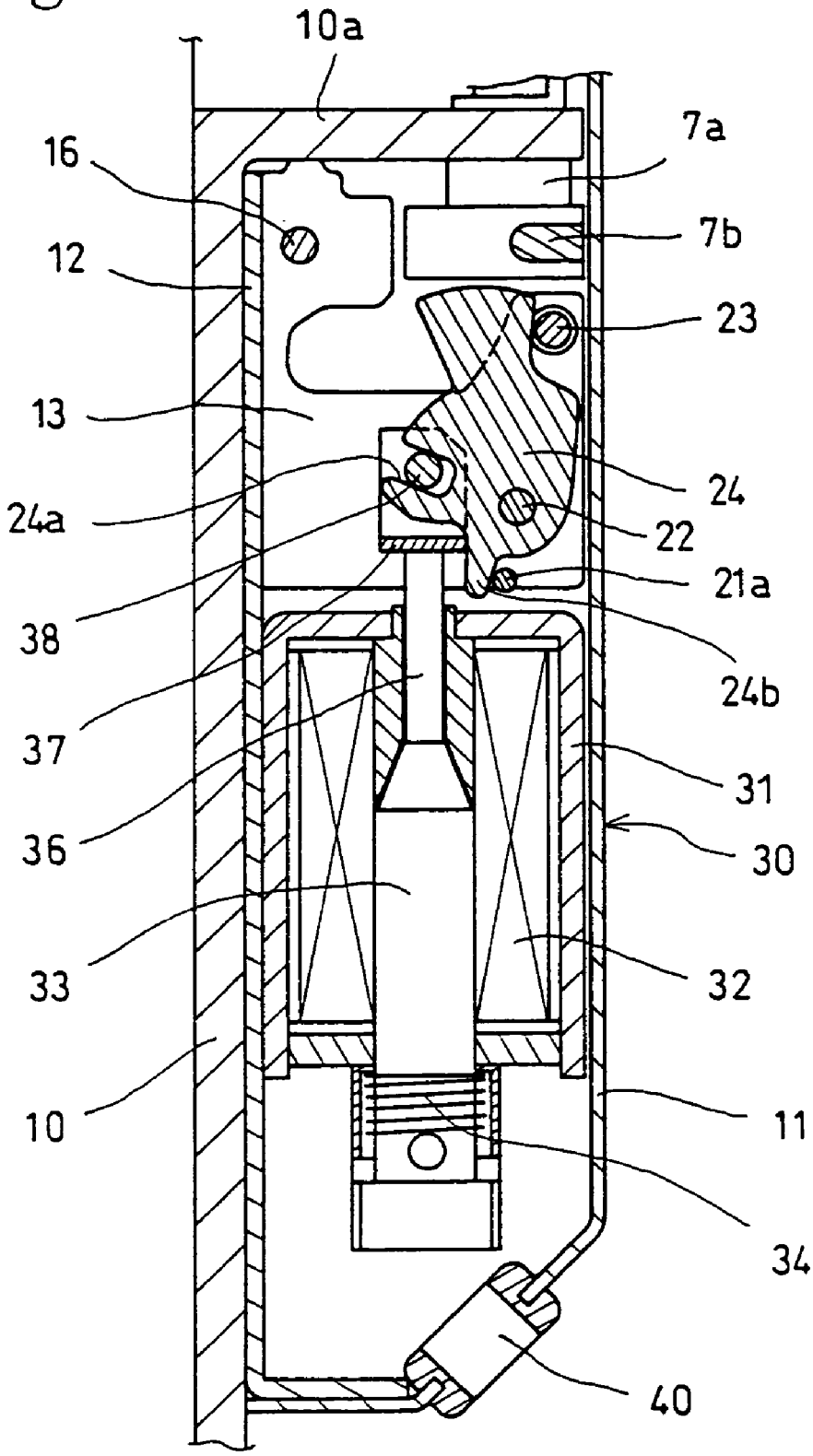
FIG. 5 is a sectional view taken on the line V—V in FIG. 3.

Referring to FIGS. 2, 3, 5, 6 and 7, a third rocking plate 24, i.e., a third member, is disposed near the second rocking plate 24 and supported by the shaft 22 supporting the second rocking plate 21 and extended between the bearing plates 13. The third rocking plate 24 is provided with a recess 24*a* in its left edge, as viewed in FIG. 5. A spring, not shown, presses the third rocking plate 24 clockwise, as viewed in FIGS. 2 and 5, toward its first position. In FIG. 5, the third rocking plate 24 is located at the first position. When the third rocking plate 24 is located at the first position, an upper part of the third rocking plate 24 rests on the stopper 23, and a projection 24*b* projecting from a lower part of the third rocking plate 24 is in contact with a pin 21*a* attached to the second rocking plate 21. The stopper 23 restrains the third rocking plate 24 from further clockwise turning beyond the first position.

When the third rocking plate 24 turns counterclockwise, as viewed in FIG. 5, the projection 24*b* of the third rocking plate 24 pushes the pin 21*a* attached to the second rocking plate 21 to turn the second rocking plate 21 counterclockwise. However, when the third rocking plate 24 turns clockwise, as viewed in FIG. 5, the pin 21*a* does not necessarily follow the projection 24*b* and hence the second rocking plate 21 does not necessarily turn clockwise. The pin 21*a* of the second rocking plate 21 is capable of engaging with and of disengaging from the projection 24*b* of the third rocking plate 24.

As shown in FIG. 5, the linear solenoid actuator 30 is attached to the mounting plate 12. The solenoid actuator 30 comprises a case 31, a solenoid 32, a movable core 33, and a spring 34. The movable core 33 is moved up by electromagnetic force when the solenoid 32 is energized, and is moved down by the resilience of the spring 34 when the solenoid is de-energized. FIG. 5 shows the solenoid actuator 30 in a state where the solenoid 32 is energized and the movable core 33 is held at its upper position. In FIG. 5, indicated at 40 is a grommet through which a cable for supplying power to the solenoid 32 is passed.

A rod 36 is fixedly joined to the upper end of the movable core 33. A U-shaped forked member 37 having opposite legs is attached to the upper end of the rod 36, and a pin 38 is extended between the opposite legs of the forked member 37. The pin is engaged in the recess 24*a* of the third rocking plate 24.

FIGS. 10A, 11A, 12A, 13A, 14A, 10B, 11B, 12B, 13B and 14B are views for explaining a series of sequential operations of the door lock device in this embodiment. FIGS. 10A to 14A are horizontal plan views showing the different conditions of the hook 6 and the hook control member 7. FIGS. 10B to 14B are front elevations of a lower half of FIG. 2, in conditions corresponding to those shown in FIGS. 10A to 14A, respectively. Although the door lock device is illustrated in a horizontal position in FIGS. 10B to 14B for the convenience of arrangement of the drawings, actually, the door lock device is installed in a vertical position.

Figure 9:
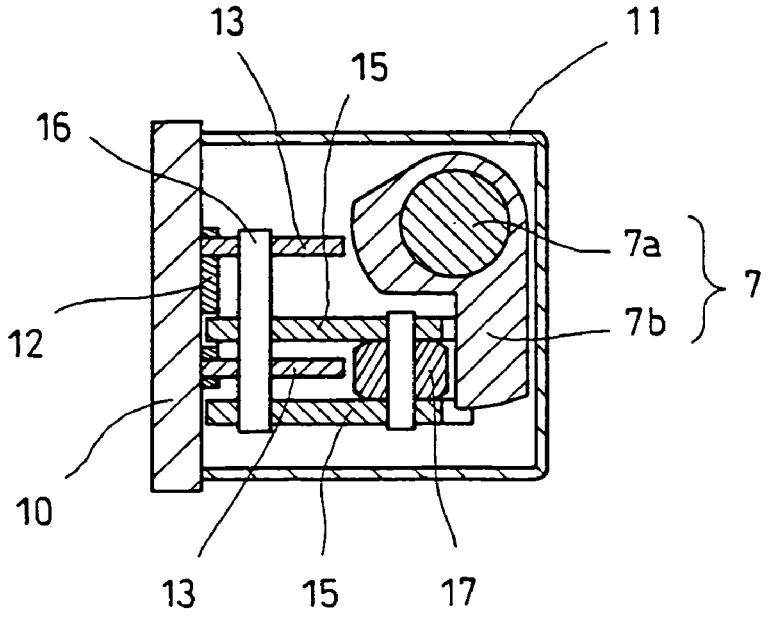
FIG. 9 is a sectional view taken on the line IX—IX in FIG. 2 or 3.
Figure 10A:
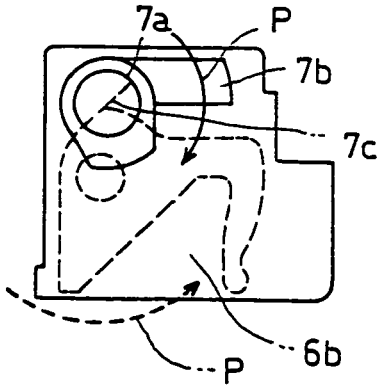
FIGS. 10A, 11A, 12A, 13A and 14A are plan views of assistance in explaining the operations of a hook and a hook control member included in the door lock device shown in FIGS. 1A and 1B.
Figure 10B:
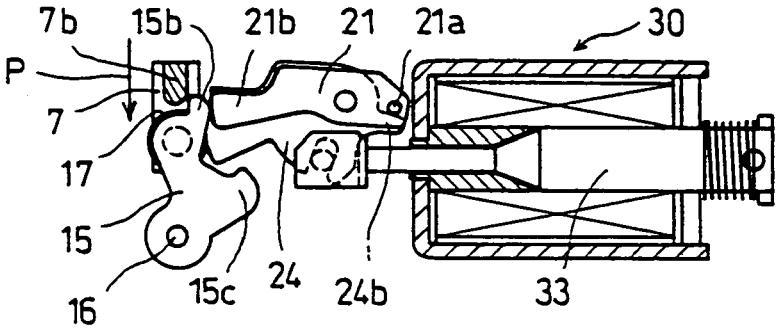
FIGS. 10B, 11B, 12B, 13B and 14B are partly sectional front elevations, corresponding to FIGS. 10A, 11A, 12A, 13A and 14A, of assistance in explaining the operations of a solenoid actuator and a plurality of rocking plates.

Referring to FIGS. 10A and 10B showing the door lock device in a fastened state where the solenoid 32 of the solenoid actuator 30 is energized, the movable core 33 of the solenoid actuator 30 is pushed up (moved to the left as viewed in FIG. 10B), the third rocking plate 24 is at the first position, and the second rocking plate 21 is turned clockwise to the first position by the spring. In this state, the pin 21*a* is in contact with the projection 24*b* of the third rocking plate 24, and the upper part 21*b* is in contact with the stopper 23 (FIGS. 2 and 4). Consequently, the first rocking plates 15 are detained at the first position, the roller 17 supported on the first rocking plates 15 is in contact with the lever 7*b* of the hook control member 7 to detain the hook control member 7 at the first position as shown in FIGS. 9 and 10A. The middle part 7*c*, having a semicircular cross section, of the shaft 7*a* of the hook control member 7 pressed against the back of the hook 6 detains the hook 6 at the latch detaining position as shown in FIG. 8. Consequently, the latch 2 (FIG. 1) projecting from the side surface 1*a* of the swing door 1 is engaged in the groove 6*b* of the hook 6 and the swing door 1 cannot be opened.

Even if the door lock device is in such a fastened state, the swing door 1 can be unlocked and can be opened by operating a thumb turn mechanism accessible from a position on one side of the swing door 1 (FIG. 1A), such as on the inner side of the swing door 1, to retract the latch 2 of the swing door 1 against the resilience of the spring. The swing door 1 can be unlocked and opened by unfastening another lock attached to the swing door 1 and combined with the latch 2 with a key for operating the lock so as to retract the latch 2. When the swing door 1 is closed again, the inclined surface (the upper surface as viewed in FIG. 1A) of the latch 2 projecting from the side surface 1*a* of the swing door 1 engages with and rides over the side edge of the hook 6 causing the latch 2 to retract, and engages in the groove 6*b* of the hook 6 to lock the latch 2. Thus, the swing door 1 is closed and locked again.

Figure 11A:
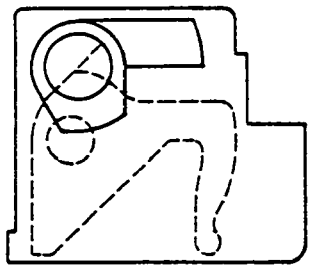
Figure 11B:
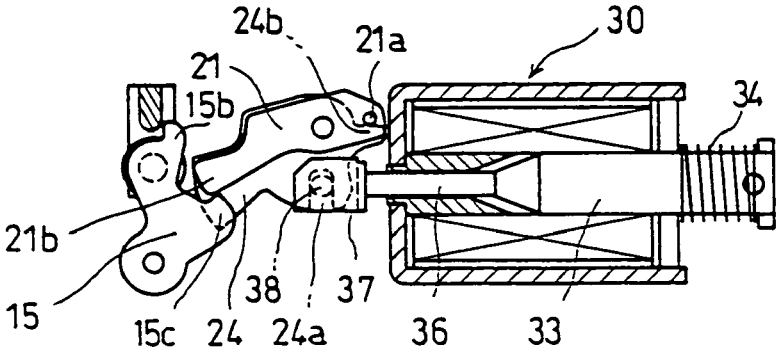

Referring to FIGS. 11A and 11B showing the solenoid actuator 30 in a state immediately after the solenoid 32 of the solenoid actuator 30 has been de-energized, the movable core 33 is moved down (to the right as viewed in FIG. 11B) by gravity and the resilience of the spring 34. Then, the pin 38 fixed to the forked member 37 attached to the rod 36 joined to the movable core 33, and engaged in the recess 24*a* of the third rocking plate 24 turns the third rocking plate 24 counterclockwise against the resilience of the spring. Then, the projection 24*b* in engagement with the pin 21*a* turns the second rocking plate 21 counterclockwise. Consequently, the upper part 21*b* of the second rocking plate 21 in contact with the projection 15*b* of the first rocking plate 15 moves rapidly to the left (downward as viewed in FIG. 111B) and strikes the second projections 15*c* (impact-receiving parts) of the first rocking plates 15.

Figure 12A:
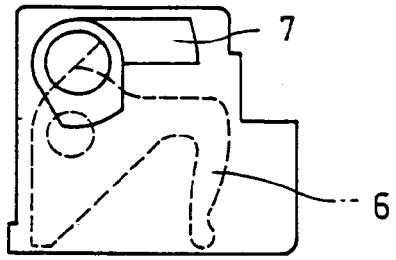
Figure 12B:
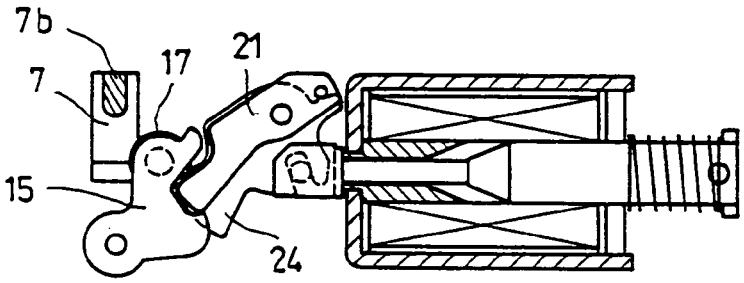

Consequently, as shown in FIG. 12B, the first rocking plate 15 is turned clockwise against the resilience of the spring and thereby the roller 17 is moved down (to the right as viewed in FIG. 12B) away from the moving range of the lever 7*b* of the hook control member 7 to release the hook control member 7 detained at the first position. At this stage, the first rocking plate 15, the second rocking plate 21 and the third rocking plate 24 are detained at second positions shown in FIG. 12B, respectively.

Figure 13A:
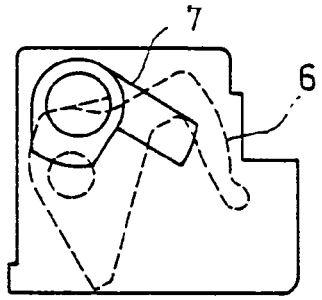
Figure 13B:
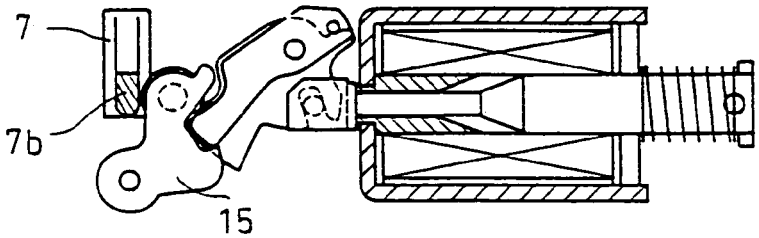
Figure 14A:
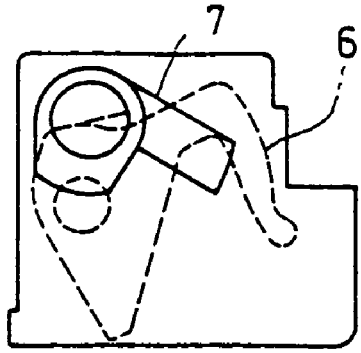

In a state shown in FIG. 12B, the hook control member 7 is not restrained from turning, and the hook 6 is released and is not detained at the latch detaining position. Therefore, if the swing door 1 is pushed manually in the opening direction, the hook 6 is turned counterclockwise and the hook control member 7 is turned clockwise as viewed in FIG. 1B or 13A against the resilience of the springs and the swing door 1 can be opened. FIG. 12A shows the door lock device in an unfastened state, and FIGS. 13A and 14A show the opening process of the swing door 1 with the door lock device in the unfastened state.

After the swing door 1 has been opened, the hook 6 and the hook control member 7 are returned to the positions shown in FIGS. 1A and 12A by the springs, respectively. If the open swing door 1 is pushed manually or by a door check in the closing direction, the hook 6 and the hook control member 7 are not turned, the latch 2 projecting from the side surface 1*a* of the swing door 1 is forced to retract against the resilience of the spring and rides over the edge of the hook 6 as the swing door 1 is turned in the closing direction. Finally, the latch 2 engages in the groove 6*b* of the hook 6 as shown in FIG. 1A to lock the swing door 1.

Subsequently, the solenoid 32 of the solenoid actuator 30 is energized to make the unfastened door lock device fasten, the movable core 33 of the solenoid actuator 30 is pushed up (moved to the left as viewed in FIG. 14B) against gravity and resilience of the spring 34 to turn the third rocking plate 24 clockwise to the fist position, so that the second rocking plate 21 detained at the second position is released. If the swing door 1 is not closed completely, the hook 6 is not located exactly at the latch detaining position and the hook control member 7 is not located exactly at the hook detaining position due to some cause, the first rocking plate 15 and the second rocking plate 21 are unable to turn from their second positions. In this state, the third rocking plate 24 is at the first position, the second rocking plate 21 is at the second position, and the projection 24*b* of the third rocking plate 24 is separated from the pin 21*a* of the second rocking plate 21 as shown in FIG. 14B.

Figure 14B:
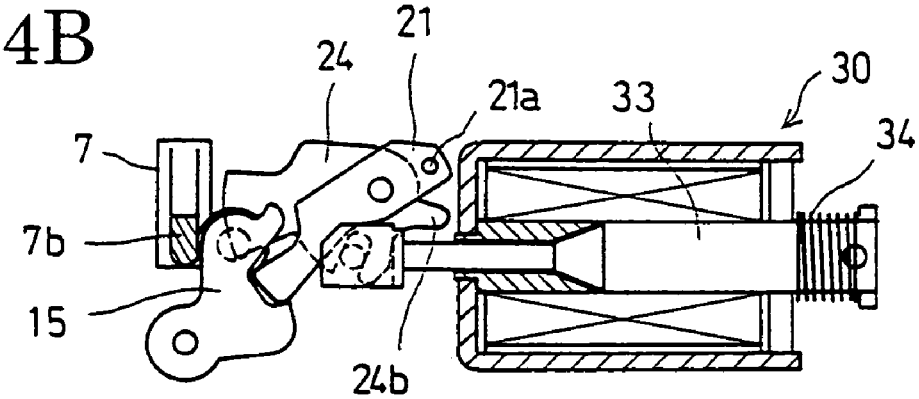
Figure 15A:
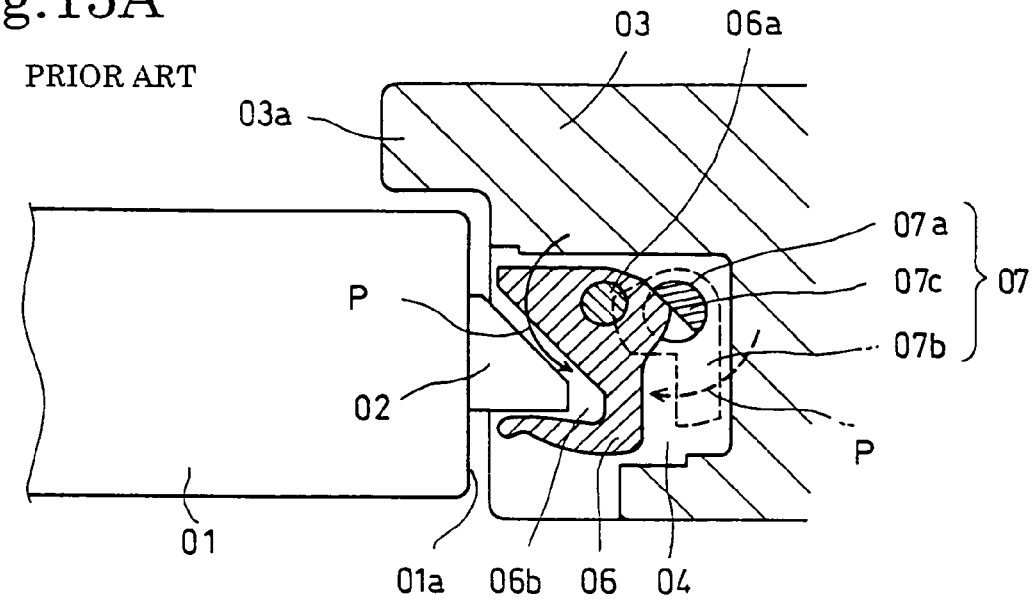
Fig.15A PRIOR ART
FIGS. 15A and 15B are horizontal sectional views of a conventional door lock device that fastens when an electric power source is connected thereto in a fastened state, and unfastens when the electric power source is disconnected therefrom in an unfastened state, respectively, shown in combination with a swing door.
Figure 15B:
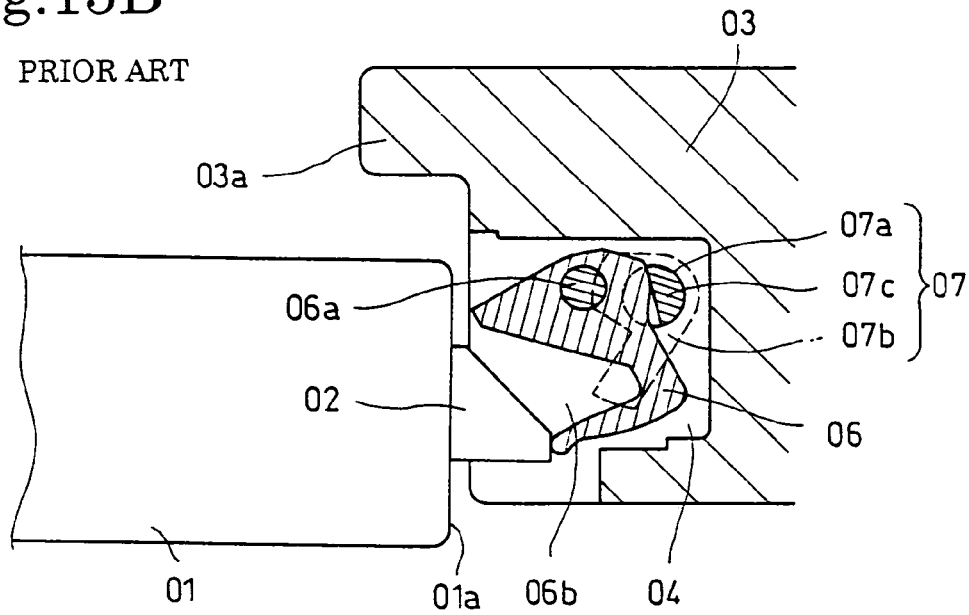
Fig.15B PRIOR ART
Figure 16A:
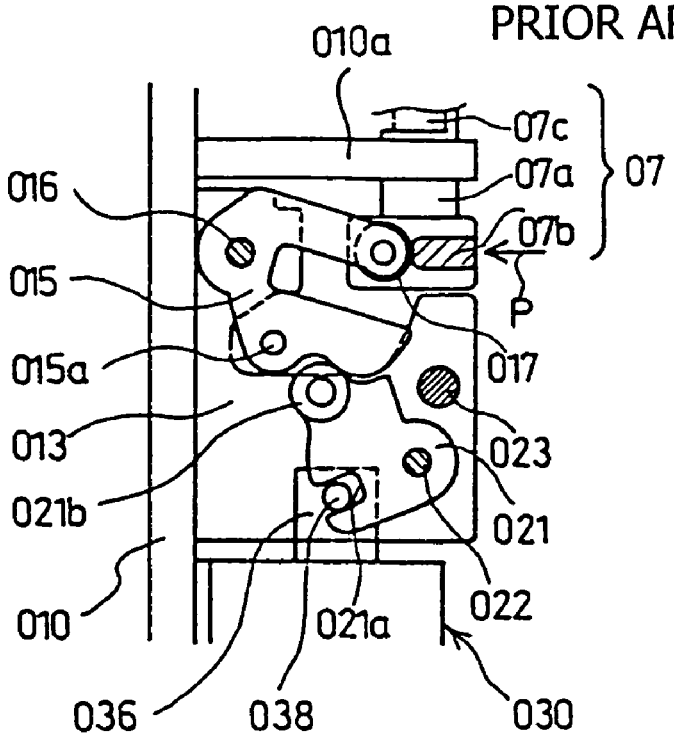
Fig.16A PRIOR ART
FIGS. 16A and 16B are front elevations of the door lock device shown in FIGS. 15A and 15B showing a hook control member locking mechanism including a solenoid actuator for detaining a hook control member at its first position and releasing the same from the first position
Figure 16B:
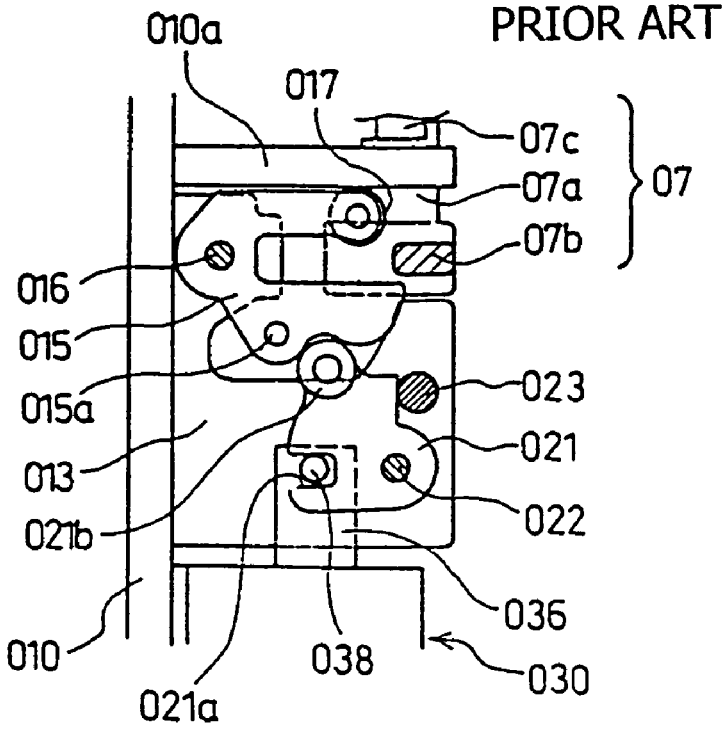
Fig.16B PRIOR ART

If the swing door 1 is closed manually completely with the door lock device in the state shown in FIG. 14B, the hook 6 and the hook control member 7 are returned to the latch detaining position and the hook detaining position, respectively, by the resilience of the springs. Consequently, the first rocking plate 15 and the second rocking plate 21 are returned to their first positions by the resilience of the springs, and the pin 21*a* of the second rocking plate 21 comes into contact with the projection 24*b* of the third rocking plate 24. Thus, the door lock device is reset to the fastened state shown in FIG. 10A.

If a high lateral pressure P is applied to the hook 6 in a direction to open the swing door 1 with the door lock device fastened as shown in FIGS. 1A and 10A, the lateral pressure P presses the lever 7*b* of the hook control member 7 against the roller 17 of the first rocking plate 15, and the roller 17 exerts a high frictional resistance against the movement of the lever 7*b*. However, in the door lock device embodying the present invention, the upper part 21*b* of the second rocking plate 21 moves for a hammering action to apply an impact to the second projections (impact-receiving parts) 15*c* of the first rocking plates 15 instead of applying a static pressure to the second projections 15*c* of the first rocking plates 15. Thus, the first rocking plate 15 can be easily turned clockwise as shown in FIGS. 11B and 12B with reliability. Since the projection 15*b* of the first rocking plate 15 is not pressed against the upper part 21*b* of the second rocking plate 21 in the state shown in FIG. 10B, the upper part 21*b* of the second rocking plate 21 is able to move away easily from the projection 15*b* of the first rocking plate 15. An inertial force makes the upper part 21*b* of the second rocking plate 21 strike the second projections 15*c* (impact-receiving parts) of the first rocking plates 15.

In the door lock device embodying the present invention, the second rocking plate 21 that disengages the first rocking plate 15 from the lever 7*b* of the hook control member 7 and turns the first rocking plate 15 to the second position is interlocked with the pin 38 attached to the fork member 37 attached to the rod 36 joined to the movable core 33 of the solenoid actuator 30 through the third rocking plate 24 instead of being engaged directly with the pin 38. Therefore, only the third rocking plate 24 interlocked with the movable core 33 of the solenoid actuator 30 can be turned to the first position with the first rocking plate 15 and the second rocking plate 21 located at their second positions as shown in FIG. 14B when the solenoid 32 of the solenoid actuator 30 is energized to fasten the door lock device even if the swing door 1 is not closed completely and the hook 6 and the hook control member 7 are dislocated respectively from the latch detaining position and the hook detaining position due to some cause. Then, the door lock device can be fastened as shown in FIG. 10A by completely closing the swing door 1 after turning the third rocking plate 24 to the first position.

Although there has been described what is the present embodiment of the invention, it will be understood that variations and modifications may be made thereto without departing from the spirit or essence of the invention.

What is claimed is:

1. A door lock device comprising:

a latch placed in a side part of a swing door hinged for swinging in an opening of a building to open and close the opening, said latch being elastically pressed so as to project from the side part of the swing door, and capable of being manually pushed into the swing door;

a hook disposed so as to engage with the latch in a cavity formed in a part of a door frame defining the opening of the building and corresponding to the latch, said hook being capable of turning between a latch detaining position for detaining the latch and a latch releasing position for releasing the latch;

a hook control member provided to move between a hook detaining position for restraining the hook from turning from the latch detaining position and a hook releasing position for permitting the hook to turn to the latch releasing position;

an actuator having a rod capable of being advanced for a locking operation and retracted for an unlocking operation;

a first member capable of turning between a first position for detaining the hook control member at the hook detaining position and a second position for permitting the hook control member to turn to the hook releasing position, and pressed in a direction from the second position toward the first position;

a second member having one end that engages with the first member to detain the first member at the first position, said second member being provided to turn between a first position where the one end thereof detains the first member at its first position and a second position where the one end thereof is separated from the first member to permit the first member to turn to its second position, said second member being pressed in a direction from its second position toward its first position, and provided with an engaging member; and a third member supported for turning adjacent to the second member so as to be turned by the actuator, capable of being turned to a first position by advancing the rod of the actuator and to a second position by retracting the rod of the actuator, said third member being pressed in a direction from its second position toward its first position, and capable of restraining the second member from turning toward its first position by engaging with the engaging member of the second member;

wherein the first member has a impact-receiving part that receives impact exerted thereon by the second member when the rod of the actuator is retracted and the second member turns from its first to its second position, whereby the first member can be surely turned toward its second position by the impact exerted on the impact-receiving part thereof.

2. The door lock device according to claim 1, wherein the second member is disposed relative to the first member so that the one end thereof exerts the impact on the impact-receiving part of the first member.

3. The door lock device according to claim 1, wherein the impact-receiving part is a projection formed in the first member.

4. The door lock device according to claim 1, wherein the second and the third members are supported on a common shaft.

5. The door lock device according to claim 1, wherein the engaging member of the second member is a pin.

6. The door lock device according to claim 1, wherein the third member is provided with a projection that engages with the engaging member.

7. The door lock device according to claim 1, wherein the second and the third member are restrained from turning beyond their first positions by stoppers, respectively.

8. The door lock device according to claim 1, wherein the third member is provided with a recess, and the rod of the actuator is provided with a pin so as to engage in the recess of the third member.

9. The door lock device according to claim 1, including a pair of the first members.

10. The door lock device according to claim 9, wherein the pair of the first members are connected in spaced relation to each other.

11. The door lock device according to claim 4, wherein at least one of the second and third members are rotatable relative to the other about said common shaft.

12. The door lock device according to claim 1, wherein the first member includes a roller that engages the hook control member to detain the hook control member at the hook detaining position, and when said impact-receiving part receives the impact exerted by the second member the roller is disengaged from the hook control member.

* * * * *

UNITED STATES PATENT AND TRADEMARK OFFICE

CERTIFICATE OF CORRECTION

PATENT NO. : 6,966,585 B2
APPLICATION NO. : 10/749804
DATED : November 22, 2005
INVENTOR(S) : Egi et al.

It is certified that error appears in the above-identified patent and that said Letters Patent is hereby corrected as shown below:

Column 3:

Between lines 41 and 42, insert the heading -- SUMMARY OF THE INVENTION --.

Column 4:

Line 15, change "a impact-receiving part" to -- an impact-receiving part --.

Column 6:

Line 9, delete "of the middle part 7*c*".

Lines 42-43, change "When th first rocking" to -- When the first rocking --.

Line 47, change "rocking plates 15. when" to -- rocking plates 15. When --.

Line 50, between "detaining position." and "The first", insert the sentence -- The first rocking plates restrain the hook 6 from turning through the hook control member 7. --.

Column 8:

Line 38, change "FIG. 111B" to -- FIG. 11B --.

Column 9:

Line 10, change "the fist position" to -- the first position --.

Column 10:

Line 59, change "a impact-receiving part" to -- an impact-receiving part --.

Signed and Sealed this

Twenty-ninth Day of April, 2008

JON W. DUDAS
*Director of the United States Patent and Trademark Office*